US011952863B2

(12) United States Patent
Cameron

(10) Patent No.: US 11,952,863 B2
(45) Date of Patent: Apr. 9, 2024

(54) APPARATUS FOR USE IN A DOWNHOLE TOOL AND METHOD OF OPERATING SAME

(71) Applicant: Expro North Sea Limited, Dyce (GB)

(72) Inventor: Euan Ross Cameron, Dyce (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 17/801,473

(22) PCT Filed: Feb. 9, 2021

(86) PCT No.: PCT/EP2021/053106

§ 371 (c)(1),
(2) Date: Aug. 22, 2022

(87) PCT Pub. No.: WO2021/165103

PCT Pub. Date: Aug. 26, 2021

(65) Prior Publication Data

US 2023/0287761 A1 Sep. 14, 2023

(30) Foreign Application Priority Data

Feb. 21, 2020 (GB) ..... 2002490

(51) Int. Cl.
*E21B 34/06* (2006.01)

(52) U.S. Cl.
CPC ..... *E21B 34/066* (2013.01); *E21B 34/063* (2013.01)

(58) Field of Classification Search
None
See application file for complete search history.

(56) References Cited

U.S. PATENT DOCUMENTS

| | | | | |
|---|---|---|---|---|
| 6,679,324 | B2 * | 1/2004 | Den Boer | E21B 34/066 166/66.6 |
| 7,971,651 | B2 * | 7/2011 | Tanju | E21B 34/14 166/373 |
| 2010/0050905 | A1 | 3/2010 | Lewis | |
| 2011/0056679 | A1 | 3/2011 | Rytlewski | |
| 2015/0027723 | A1 * | 1/2015 | Fripp | E21B 34/063 166/373 |
| 2015/0247382 | A1 | 9/2015 | Murphree | |
| 2017/0009563 | A1 | 1/2017 | Holder | |
| 2018/0283121 | A1 | 10/2018 | Zhang | |
| 2018/0283142 | A1 | 10/2018 | Zhang | |
| 2021/0047895 | A1 * | 2/2021 | Sherman | E21B 34/063 |
| 2022/0186578 | A1 * | 6/2022 | Least | E21B 34/14 |

* cited by examiner

*Primary Examiner* — Taras P Bemko
(74) *Attorney, Agent, or Firm* — Getz Balich LLC

(57) ABSTRACT

An apparatus for use in a downhole tool is provided. The apparatus includes a membrane configured to isolate an internal environment of the downhole tool from one or more further environments, internal and/or external to the downhole tool; and an electrical element configured to conduct an electrical current. The electrical element is positioned with respect to the membrane such that energy generated by the electrical current passing through the electrical element is incident on the membrane. The membrane is configured to be weakened and/or ruptured when the energy is incident thereon to allow fluid communication between the internal environment and the further environment.

21 Claims, 8 Drawing Sheets

APPARATUS FOR USE IN A DOWNHOLE TOOL AND METHOD OF OPERATING SAME

This application claims priority to PCT Patent Appln. No. PCT/EP2021/053106 filed Feb. 9, 2021, which claims priority to GB Patent Appln. No. 2002490.7 filed Feb. 21, 2020, which are hereby incorporated herein by reference in their entireties.

BACKGROUND OF THE INVENTION

1. Technical Field

The subject application generally relates to downhole tool activation, and specifically to an apparatus for use in a downhole tool and method of operating the same.

2. Background Information

The oil and gas industry utilizes a variety of devices whose functionality are controlled by pressure. This functionality may be single-cycle, such as a pressure activated rupture disc. Applicant's own drill stem testing valves include an annulus operated reversing valve (AORV), self-fill tubing test valve (SF-TTV), downhole safety valve (DHSV) and annulus reference trap system (ARTS) which are controlled by pressure. Other pressure actuated devices include Schlumberger™'s single-shot reversing valve and Haliburton™'s rupture disc safety circulating valve.

Pressure activated technology, such as a single-cycle pressure activated rupture disc, functions by rupturing when a threshold bursting pressure is reached. The pressure activated rupture disc ruptures and releases the built up pressure. The released built up pressure is then used to activate further pressure activated technology.

A single pressure activated rupture disc may operate at a particular threshold bursting pressure. As will be appreciated, when multiple pressure activated tools are required, the available pressure operating window limits the number of tools that may be accommodated in a downhole application, such as a single drill string. Furthermore, such pressure activated technology may not function at pressures below the particular threshold bursting pressure of the pressure activated rupture disc.

Electrically activated downhole tools are also used in the oil and gas industry. These systems typically use solenoids or pilot valves to activate downhole valves. Exemplary downhole tools utilize wireless communication methods to receive control signals to downhole control modules that in turn control one or more valves of the downhole tools.

Such electrically activated downhole tools must necessarily include communication systems to receive control signals communicated downhole, and power supplies to power the communication systems and control modules that control associated valves. Exemplary power supplies that control valves include motorized screws and pressurized oil reservoirs. Such power supplies may be of significant size, cost and technical complexity. While such significant size, cost and complexity may be viable when developing and operating a multi-cycle tool such as a downhole testing/circulating valve, the use cases and revenues generated from single-cycle tools make such power supplies unsound.

This background serves only to set a scene to allow a person skilled in the art to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY

In some or more examples, an apparatus for use in a downhole tool is provided. The apparatus does not operate on the basis of pressure differential as is the case with pressure activated rupture discs. As such, the apparatus may be used in a wide variety of pressure environments and in conjunction with multiple other apparatus that are each independently controlled. In contrast with pressure activated rupture discs, the apparatus is not dependent on a particular pressure differential.

The apparatus may be used in a wider variety of applications than conventional pressure activated rupture discs as the apparatus is not dependent on particular pressure windows.

In some or more examples, the apparatus comprises membrane configured to isolate an internal environment of the downhole tool from one or more further environments, internal and/or external to the downhole tool; and an electrical element configured to conduct an electrical current. The electrical element is positioned with respect to the membrane such that energy generated by the electrical current passing through the electrical element is incident on the membrane. The membrane is configured to be weakened and/or ruptured when the energy is incident thereon to allow fluid communication between the internal environment and the further environment.

In contrast with pressure activated rupture discs, the membrane does not weaken and/or rupture due to force exerted by pressure, but rather the membrane is weakened or ruptured by energy generated by the electrical element. Thus, the apparatus is not dependent on particular pressure windows, but rather weakening or rupturing of the membrane may be controlled by controlling energy generation by the electrical element.

The apparatus does not require as many moving parts, as high a cost or as much space as conventional electrically activated valve systems that use electrically controlled solenoids or pilot valves to operate equipment. As, the apparatus has fewer moving parts, the apparatus is more robust and less prone to electrical or mechanical failure than conventional electrically activated valve systems. Furthermore, the apparatus is cheaper and smaller than conventional systems.

In some or more examples, the energy comprises heat energy. In some or more examples, the energy comprises at least one of thermal, chemical, elastic, gravitational, radiant, sound and electrical.

The apparatus is not pressure activated. In some or more examples, the apparatus is heat activated. In some or more examples, the electrical element comprises a heating element. The heating element is configured to heat the membrane to weaken and/or rupture the membrane to allow fluid communication between the internal environment and the further environment.

In some or more examples, the electrical element comprises at least one of a voltage element, a current element and a cooling element.

In some or more examples, the membrane is configured to soften and/or melt when exposed to the heat energy. In some or more examples, the membrane is configured to rupture once softened and/or melted. In some or more examples, melting including partially melting the membrane.

In some or more examples, a melting point of the membrane is one of approximately 350, 420 and 460 degrees Celsius.

In some or more examples, the membrane comprises magnesium, tin, zinc or aluminum alloys, or a combination thereof. The melting point of the respective alloy is approximately: 350 degrees Celsius for magnesium alloy, 420 degrees Celsius for tin alloy, 420 degrees Celsius for zinc alloy, and 460 degrees Celsius for aluminum alloy.

In some or more examples, the electrical element comprises an electrically conductive wire.

In some or more examples, the electrically conductive wire is secured to the membrane.

In some or more examples, the electrically conductive element is in direct contact with the membrane. The energy generated by the electrical element passes directly incident on the membrane. This maximizes the proportion of energy incident on the membrane increasing efficiency and expediting weakening and/or rupturing of the membrane.

In some or more examples, the electrically conductive wire is formed into a planar structure. In some or more examples, the planar structure has an area greater than 10% of the surface area of the membrane. In some or more examples, the planar structure is affixed to at least a portion of the membrane. In some or more examples, the planar structure formed by the electrically conductive wire is affixed to a surface the membrane to pass energy directly incident on the membrane. In some or more examples, the planar structure is formed by the electrically conductive wire has a zig zag, serpentine, or other repeating or non-repeating pattern.

In some or more examples, the apparatus further comprises a power source electrically connected to the electrical element configured supply electrical current thereto. In some or more examples, the power source is configured to activate the electrical element to weaken and/or rupture the membrane. In some or more examples, the power source is a battery.

In some or more examples, the apparatus further comprises a controller configured to control the power source. In some or more examples, the controller is electrically connected to the power source and/or the electrical element.

In some or more examples, the apparatus further comprises a receiver configured to receive a control signal for controlling the controller. In some or more examples, the receiver takes the form of a transceiver configured to receive and transmit signals. In some or more examples, the control signal originates from a surface location or a downhole location. In some or more examples, the control signal originates from a remote location. In some or more examples, the control signal originates from a sensor or gauge.

In some or more examples, the electrical element is reusable. In some or more examples, after pressure release, the electrical element is collected and reused. In some or more examples, the membrane is disc shaped. In some or more examples, the membrane has a diameter of 0.250 inches (0.635 cm). In some or more examples, the membrane has a thickness of 0.062 inches (0.159 cm).

In some or more examples, the membrane is configured to be supported within a housing of the downhole tool. In some or more examples, the housing is a valve housing. In some or more examples, the membrane spans an aperture of the valve housing. The membrane forms a barrier between the external pressure and internal pressure of the valve housing.

In some or more examples, the membrane has a pressure rating of 15,000 psi (103.421 MPa). In some or more examples, the membrane has a pressure rating of 30,000 psi (206.843 MPa).

In some or more examples, the membrane is welded into an enclosure. In some or more examples, the membrane is machined from an enclosure. The enclosure may be fitted into the housing. In some or more examples, the enclosure is secured in the housing by fastener or threaded engagement.

In some or more examples, an internal surface of the membrane is exposed to internal pressure.

In some or more examples, an external surface of the membrane is exposed to external pressure.

In some or more examples, the external pressure is greater than the internal pressure. In some or more examples, the external pressure is less than the internal pressure.

In some or more examples, the apparatus comprises a valve. In some or more examples, the apparatus comprises at least one of a fluid release or relief device, a pressure release or relief device, a fluid communication device and a fluid communication controller.

In some or more examples, a downhole tool is provided. The downhole tool comprises the described apparatus. In some or more examples, the downhole tool is a drill stem testing (DST) tool.

In some or more examples, the downhole tool comprises multiple apparatus. In some or more examples, each apparatus provides a separate and unique hydraulic functionality. In some or more examples, each individual electrical element of individual apparatus are separately controlled.

The downhole tool is less complex, has a lower cost, requires less space and is less complex than conventional electrically activated valve systems. Furthermore, the downhole tool is not reliant on a particular pressure window as with conventional pressure activated rupture discs.

In some or more examples, the downhole tool further comprises a hydraulically functioning element. Fluid released into the internal environment after weakening and/or rupturing of the membrane at least partially operates the hydraulically functioning element.

In some or more examples, operation of the hydraulically functioning element comprises at least one of moving a piston, activating a further valve, opening and/or closing a valve, firing one or more perforating guns, fracturing a formation and collecting a sample. Exemplary valve types include ball, gate, globe, plug, butterfly, check, diaphragm, pinch, pressure relief and control valves.

In some or more examples, the apparatus is configured to release pressure out of the internal environment for protecting against overpressurization.

In some or more examples, an internal pressure within the internal environment above a threshold pressure triggers activation of the electrical element and weakening and/or rupturing of the membrane. Triggering weakening and/or rupturing of the membrane above a threshold pressure protects the internal environment of the downhole tool against overpressurization.

In some or more examples, the apparatus is configured to release pressure out of the internal environment for protecting against underpressurization. In some or more examples, an internal pressure within the internal environment of the downhole tool below a threshold pressure triggers activation of the electrical element and weakening and/or rupturing of the membrane. Triggering weakening and/or rupturing of the membrane below a threshold pressure protects the internal environment of the downhole tool against underpressurization and potentially damaging vacuum conditions.

In some or more examples, a membrane is provided. The membrane does not rupture due to force exerted by pressure, but rather the membrane is weakened and/or ruptured by energy generated by an electrical element.

In some or more examples, the membrane is configured to isolate an internal environment of a downhole tool from one or more further environments, internal and/or external to the downhole tool, and further configured to be weakened and/or ruptured when energy generated by an electrical current passing through an electrical element proximal to the membrane is incident thereon to allow fluid communication between the internal environment and the further environment.

In some or more examples, the energy comprises heat energy. In some or more examples, the energy comprises at least one of thermal, chemical, elastic, gravitational, radiant, sound and electrical.

In some or more examples, the membrane is supported within a valve housing of the downhole tool.

In some or more examples, the membrane is meltable.

In some or more examples, the membrane comprises magnesium, tin, zinc or aluminum alloys, or a combination thereof. The melting point of the respective alloy is approximately: 350 degrees Celsius for magnesium alloy, 420 degrees Celsius for tin alloy, 420 degrees Celsius for zinc alloy, and 460 degrees Celsius for aluminum alloy.

In some or more examples, the membrane is disc shaped. In some or more examples, the membrane has a diameter of 0.250 inches (0.635 cm). In some or more examples, the membrane has a thickness of 0.062 inches (0.159 cm).

In some or more examples, a melting point of the membrane is one of approximately 350, 420 and 460 degrees Celsius.

In some or more examples, a method of operating an apparatus for use in a downhole tool is provided. In contrast with conventional pressure activated rupture discs, the method operates the apparatus by weakened and/or ruptured a membrane by energy generated by an electrical element rather than force exerted by pressure. As such, the method is not dependent on pressure, but can still utilize pressure to provide hydraulic functions.

In some or more examples, the method comprises positioning a membrane to isolate an internal environment of the downhole tool from one or more further environments, internal and/or external to the downhole tool; positioning an electrical element configured to conduct an electrical current, with respect to the membrane such that energy generated by the electrical current passing through the electrical component element is incident on the membrane; and applying the electrical current to the electrical element to weaken and/or rupture the membrane when the energy is incident thereon to allow fluid communication between the internal environment and the further environment.

In some or more examples, the method further comprises operating a hydraulically functioning element at least partially from fluid released into the internal environment after weakening and/or rupturing of the membrane.

In some or more examples, operating the hydraulically functioning element comprises moving a piston, activating a further valve, opening and/or closing a valve, firing one or more perforating guns, fracturing a formation and collecting a sample. Exemplary valve types include ball, gate, globe, plug, butterfly, check, diaphragm, pinch, pressure relief and control valves.

Aspects of the inventions described may include one or more examples, embodiments or features in isolation or in various combinations whether or not specifically stated (including claimed) in that combination or in isolation.

BRIEF DESCRIPTION OF THE DRAWINGS

A description is now given, by way of example only, with reference to the accompanying drawings, in which.

DETAILED DESCRIPTION OF THE INVENTION

Figure 1:
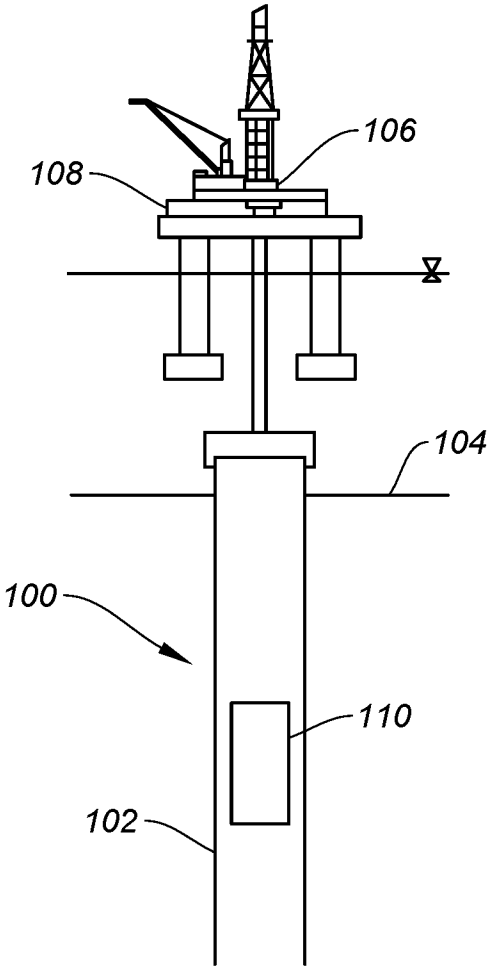
FIG. 1 is a simplified representation of a well structure with a downhole tool.

The foregoing summary, as well as the following detailed description of certain embodiments will be better understood when read in conjunction with the accompanying drawings. As will be appreciated, like reference characters are used to refer to like elements throughout the description and drawings. As used herein, an element or feature recited in the singular and preceded by the word "a" or "an" should be understood as not necessarily excluding a plural of the elements or features. Further, references to "one example" or "one embodiment" are not intended to be interpreted as excluding the existence of additional examples or embodiments that also incorporate the recited elements or features of that one example or one embodiment. Moreover, unless explicitly stated to the contrary, examples or embodiments "comprising", "having" or "including" an element or feature or a plurality of elements or features having a particular property might further include additional elements or features not having that particular property. Also, it will be appreciated that the terms "comprises", "has" and "includes" mean "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of describing the relationship of an element or feature to another element or feature as depicted in the figures. The spatially relative terms can however, encompass different orientations in use or operation in addition to the orientation depicted in the figures.

Reference herein to "example" means that one or more feature, structure, element, component, characteristic and/or operational step described in connection with the example is included in at least one embodiment and or implementation of the subject matter according to the present disclosure. Thus, the phrases "an example," "another example," and similar language throughout the present disclosure may, but do not necessarily, refer to the same example. Further, the subject matter characterizing any one example may, but does not necessarily, include the subject matter characterizing any other example.

Reference herein to "configured" denotes an actual state of configuration that fundamentally ties the element or feature to the physical characteristics of the element or feature preceding the phrase "configured to".

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "approximately" and "about" represent an amount close to the stated amount that still performs the desired function or achieves the desired result. For example, the terms "approximately" and "about" may refer to an amount that is within less than 10% of, within less than 5% of, within less than 1% of, within less than 0.1% of, or within less than 0.01% of the stated amount.

Some of the following examples have been described specifically in relation to well infrastructure relating to oil and gas production, or the like, but of course the systems and methods may be used with other well structures. Similarly, while in the following example an offshore well structure is described, nevertheless the same systems and methods may be used onshore, as will be appreciated.

Turning now to FIG. 1, a simplified representation of a section of a well 100 is shown. In this embodiment, the well 100 is an offshore well, although a person skilled in the art will appreciate that the well 100 may be another type of well. A well structure 102 extends from the surface to a subterranean formation. In this embodiment, the surface is the seabed or mudline 104. The well structure 102 may comprise a conductor, casing and other tubing used to recover product from the subterranean formation. The well 100 further comprises a wellhead 106, wet tree or the like, at a production platform 108. In other embodiments, the wellhead 106 is located at the mudline 104.

As a person skilled in the art will appreciate, the well 100 may further comprise an open hole section, in that there is no well structure positioned within the well 100 in the open hole section as shown in FIG. 1, or be terminated. The open hole structure may be lower than the well structure. The open hole structure may be located above the well structure 102. Similarly, a person skilled in the art will appreciate that the well 100 may be any one of a production well, injection well, appraisal well or a side track of an existing well.

As shown in FIG. 1, a downhole tool 110 is positioned within the well structure 102. The downhole tool 110 is positioned in the well structure 102 by one or more of hangers, clamps, friction fit, setting tools, etc.

In this embodiment, the downhole tool 110 is pressure activated such that hydraulic pressure released into the downhole tool 110 performs a tool function. Exemplary functions include moving a piston, activating a further valve, opening and/or closing a valve, firing one or more perforating guns, fracturing a formation and collecting a sample. Exemplary valve types include ball, gate, globe, plug, butterfly, check, diaphragm, pinch, pressure relief and control valves.

In this embodiment, the downhole tool 110 is a single cycle, use or shot tool. As a person skilled in the art will appreciate, the downhole tool 110 may instead be a multi cycle, use or shot tool. In this embodiment, the downhole tool 110 is used in drill stem testing (DST). As a person skilled in the art will appreciate, the downhole tool 110 may provide other functionality.

The downhole tool 110 may be configured to monitor the status of the well 100. In particular, in embodiments, the downhole tool 110 comprises one or more of a sensor and communication module. As a person skilled in the art will appreciate, the downhole tool 110 may comprise multiple sensors and/or communication modules.

Generally, the sensor is configured to detect at least one of force, temperature, pressure, conductivity and resistivity or other relevant metric. The sensor is communicatively connected to the communication module. The communication module is configured to transmit and/or receive communication signals.

In this embodiment, the communication module employs wired and/or wireless communication methods. Wired communication methods are through a guided transmission medium, such as a wire, other metallic structure or a material having high electromagnetic (EM) conductivity relative to a surrounding medium. Wired communication methods may utilize e-lines, slicklines, fiber optic cabling, etc. Wireless communication methods are not through a guided transmission medium. Wireless communication methods are through air, water, ground (or formation) or another medium that has substantially isotropic EM conductivity. In some or more examples, wireless communication methods utilize electromagnetic technology, acoustic technology and/or pressure wave technology.

Figure 2:
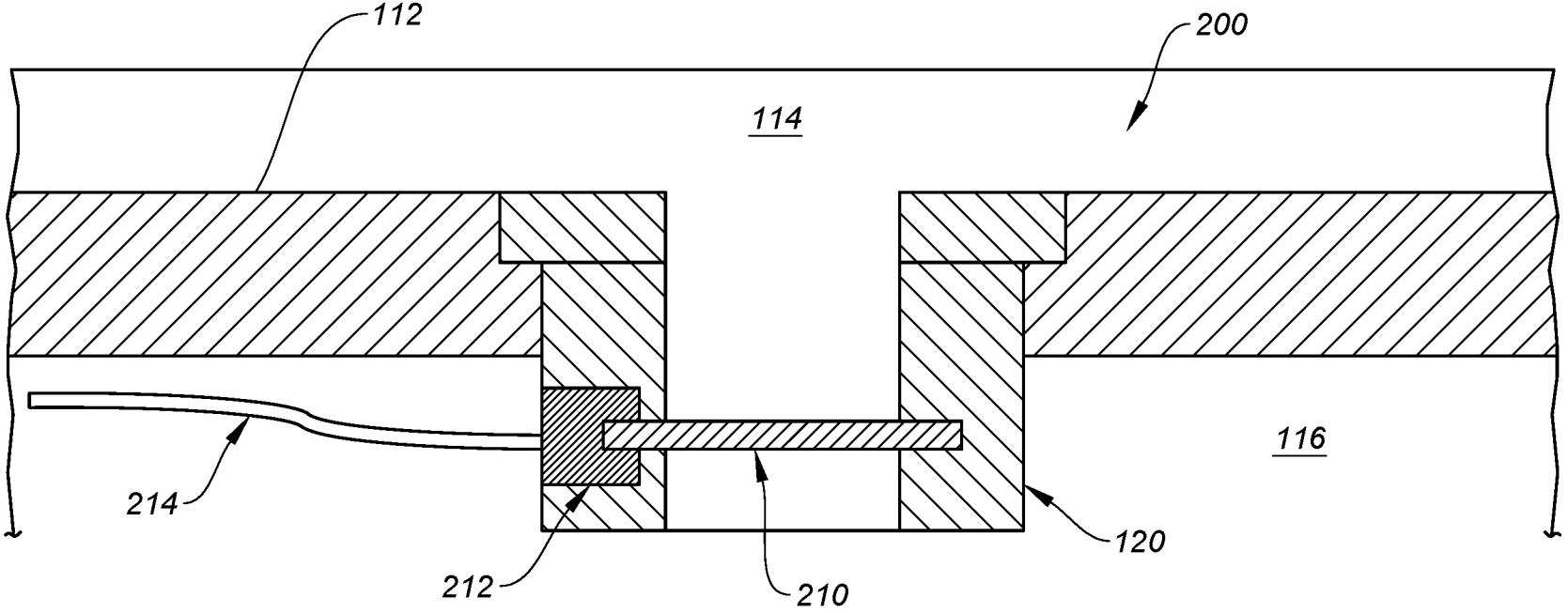
FIG. 2 is a simplified representation of a valve of a downhole tool.

Turning now to FIG. 2, a portion of the downhole tool 110 is shown. The downhole tool 110 has a sidewall 112 defining a periphery of the downhole tool 110. The sidewall 112 of the downhole tool 110 separates an environment, which in this embodiment is an external environment 114 which is external to the downhole tool 110, and the internal environment 116 of the downhole tool 110 which is internal to the downhole tool 110. The external environment 114 may an internal to the overall downhole tool 110 or may be entirely external to the downhole tool 110. In one embodiment, the external environment 114 is not within the downhole tool 110 and is within the well structure 102.

The external environment 114 is at an external pressure while the internal environment 116 is at an internal pressure. In this embodiment, the internal pressure is lower than the external pressure (the external pressure is higher than the internal pressure), although a person skilled in the art will appreciate that the external pressure may be lower than the internal pressure.

Within the outer sidewall 112 of the downhole tool 110 is a housing. In this embodiment, the housing is a valve housing 120. The valve housing 120 defines an aperture that provides a flow path between the external environment 114 and the internal environment 116.

In this embodiment, the downhole tool 110 comprises an apparatus for use in the downhole tool 110. In this embodiment, the apparatus comprises a valve 200. The valve 200 comprises a membrane 210 that is configured to isolate the internal environment 116 of the downhole tool 110 from one or more further environments, internal and/or external to the downhole tool 110. In this environment, the further environment is the external environment 114.

The valve further comprises an electrical element that is configured to conduct an electrical current. The electrical element is positioned with respect to the membrane 210 such that energy generated by the electrical current passing through the electrical element is incident on the membrane 210. The membrane 210 is configured to be weakened and/or ruptured when the energy is incident on the membrane 210 to allow fluid communication between the internal environment 116 and the external environment 114.

In this embodiment, the energy comprises heat energy. In other embodiments, the energy comprises at least one of thermal, chemical, elastic, gravitational, radiant, sound and electrical.

The membrane 210 is configured to softens and/or melts when the heat energy is incident on the membrane 210. Furthermore, in this embodiment, the electrical element comprises a heating element 212. The heating element 212 configured to heat the membrane 210. As the external pressure is higher or greater than the internal pressure in this embodiment, the heating element 212 is configured to heat the membrane 210 to allow for pressure release into the internal environment 116. Specifically, pressure release from the external environment 114 into the internal environment 116.

In other embodiments, the electrical element comprises at least one of a voltage element, a current element and a cooling element.

As stated above, the membrane 210 is configured to isolate the internal environment 116. Specifically, the membrane 210 is configured to isolate the internal environment 116 from the external environment 114. Accordingly, the membrane 210 is configured to withstand forces exerted by the external and/or internal pressure. The external pressure may be up to 15,000 psi (103.421 MPa) or up to 30,000 psi (206.843 MPa).

In this embodiment, the membrane 210 is configured to isolate a valve housing 120 of the downhole tool 110. The membrane 210 spans the aperture of the valve housing 120. The membrane 210 is configured to be supported within the valve housing 120. Specifically, the membrane 210 is fixed within the valve housing 120 to separate the external and internal environments 114 and 116, respectively. The membrane 210 isolates the valve housing 120 of the downhole tool 110.

The external surface of the membrane 210 is exposed to the external pressure in the external environment 114 and the internal surface of the membrane 210 is exposed to the internal pressure in the internal environment 116. In this embodiment, the membrane 210 is disc shaped, although a person skilled in the art will appreciate that the membrane 210 may have other shapes.

In this embodiment, the membrane 210 is meltable as will be described. In this embodiment, the membrane 210 is made of zinc alloy. In this embodiment, a melting point of the membrane 210 is approximately 420 degrees Celsius. As will be described, the membrane 210 is configured for single use only.

The membrane may comprise other alloys such as magnesium, tin, zinc and aluminum, or a combination thereof. The melting point of magnesium alloy is approximately 350 degrees Celsius. The melting point of tin alloy is approximately 420 degrees Celsius. The melting point of zinc alloy is approximately 420 degrees Celsius. The melting point of aluminum alloy is approximately 460 degrees Celsius.

As previously stated, the heating element 212 is configured to heat the membrane 210 to allow for pressure release into or out of the internal environment 116. In this embodiment, the heating element 212 is positioned within the valve housing 120. In this embodiment, the heating element 212 comprises electrically conductive wire. The electrically conductive wire is secured to the membrane 210. In this embodiment, the electrically conductive wire is in direct contact with the membrane 210. In this embodiment, the electrically conductive wire is formed in a planar structure. The planar structure has an area greater than one of 5%, 10%, 20%, 30%, 40% and 50% of the surface area of the membrane 210.

The planar structure is affixed to at least a portion of the membrane 210. The planar structure formed by the electrically conductive wire is affixed to a surface of the membrane 210 to pass energy directly incident on the membrane. The planar structure is formed by the electrically conductive wire having a zig-zag, serpentine, or other repeating or non-repeating pattern affixed to a surface of the membrane 210.

The heating element 212 is configured to heat the membrane 210 to soften or melt the membrane 210 to allow pressure release into or out of the internal environment 116. The heating element 212 is configured to heat the membrane 210 to its melting temperature. The membrane 210 is configured to soften, melt and/or rupture when heated to allow pressure release into or out of the internal environment 116.

In this embodiment, the membrane 210 is single use. However, the heating element 212 is configured for multiple use. Specifically, the heating element 212 may be recovered after use and used again to heat another membrane 210.

In this embodiment, the valve 200 further comprises a power source (not shown) electrically connected to the heating element 212. The power source is configured to supply electrical current to the heating element 212. The power source comprises at least one of a battery, an energy harvester (e.g. turbine, downhole power generation device), and wired or wireless connection to extract power.

In this embodiment, the valve 200 further comprises a controller (not shown) configured to control the power source. The heating element 212 is connected to the power source and/or controller via the electrical connection 214. The power source/controller is configured to activate the heating element 212 to heat the membrane 210 and release pressure into or out of the internal environment 116 of the downhole tool 110.

As shown in FIG. 2, in this embodiment, the electrical connection 214 is a wired connection. A person skilled in the art will appreciate that the electrical connection 214 may be a wireless connection and a signal to activate the heating element 212 may be communicated via wireless communication. In some embodiments, the signal to activate the heating element 212 is communicated via wireless communication from a remote location. In some embodiments, the remote location is topside from the well 100. In this embodiment, the valve 200 further comprises a receiver configured to receive a control signal for controlling the controller. The control signal may instruct the controller to control the power source to activated heating element 212 to heat the membrane 210. The receiver may form part of a transceiver. The control signal may be communicated through wired or wireless communication. The control signal may be communicated from a location remote from the valve 200, e.g. top side of the well 100.

While a control signal communicated from a location remote from the valve 200 has been described, a person skilled in the art will appreciate that other configurations are possible. In another embodiment, the control signal originates from a surface location or a downhole location. In another embodiment, the control signal originates from a remote location. In another embodiment, the control signal originates from a sensor or gauge. In another embodiment, the sensor and/or gauge is located downhole.

In this or another embodiment, the valve 200 further comprises one or more sensors. The sensors are configured to detect pressure, temperature, pH, force, stress, strain, chemical parameter, resistivity and/or another electrical parameter. In this embodiment, the sensor is electrically connected to the controller. The controller is controlled is configured to activate the heating element 212 when the sensor has detected a threshold parameter. For example, the controller is configured to activate the heating element 212 to heat the membrane 210 when the sensor has detected an external pressure in the external environment 114 beyond a threshold pressure.

The downhole tool 110 further comprises a hydraulically functioning element (not shown). Fluid released into the internal environment 116 after weakening and/or rupturing the membrane 210 at least partially operates the hydraulically functioning element as will be described. Operation of the hydraulically functioning element comprises at least one of moving a piston, activating a further valve, opening and/or closing a valve, firing one or more perforating guns, fracturing a formation and collecting a sample. Exemplary valve types include ball, gate, globe, plug, butterfly, check, diaphragm, pinch, pressure relief and control valves.

Figure 3:
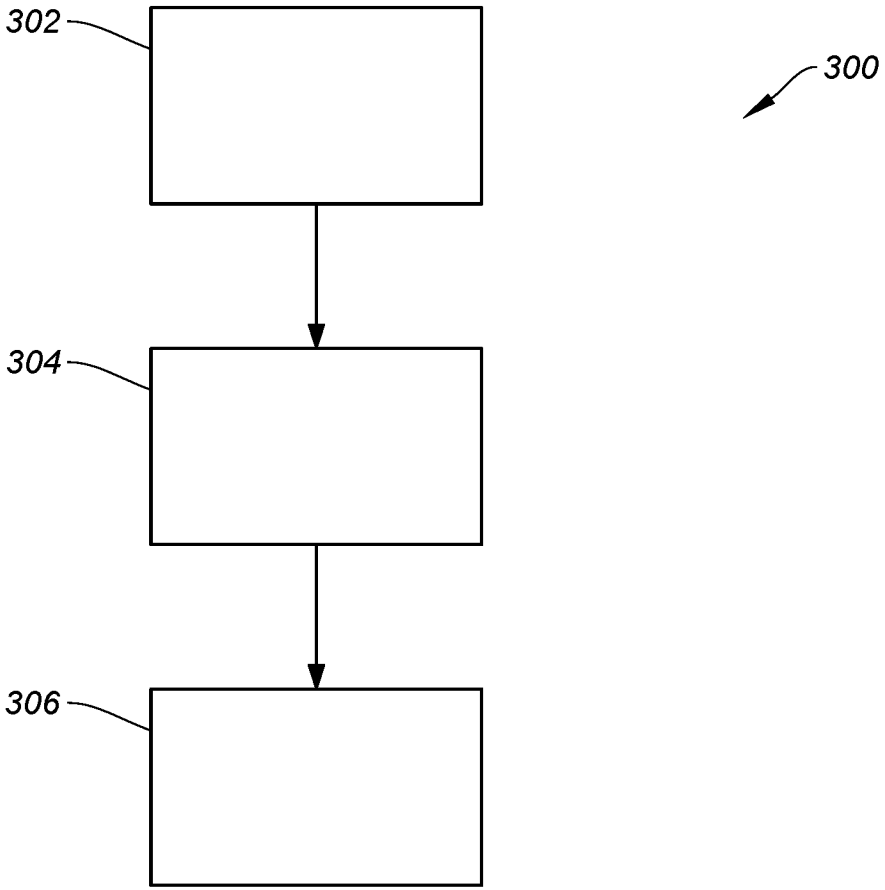
FIG. 3 is a flowchart of a method of operating a valve for use in a downhole tool.

Turning now to FIG. 3, a flowchart of a method of operating the valve 200 for use in the downhole tool 110 is shown generally identified by reference numeral 300. In this embodiment, the method 300 comprises positioning the membrane 210 to isolate the internal environment 116 of the downhole tool 110 (step 302).

The method further comprises positioning the electrical element configured to conduct an electrical current, with respect to the membrane 210 such that energy generated by the electrical current passing through the electrical element is incident on the membrane 210 (step 304). In this embodiment, the energy comprises heat energy. In other embodiments, the energy comprises at least one of thermal, chemical, elastic, gravitational, radiant, sound and electrical.

The method 300 further comprises applying the electrical current to the electrical element to weaken and/or rupture the membrane 210 when the energy is incident thereon to allow fluid communication between the internal environment 116 and the further environment (step 306).

In this embodiment, positioning 302 the membrane 210 comprises positioning the membrane 210 to isolate the internal environment 116 of the downhole tool 110 from one or more further environments, internal and/or external to the downhole tool 110. In this embodiment, the further environment is the external environment 114. In this embodiment, positioning 302 the membrane 210 comprises positioning the membrane 210 in the valve housing 120. The membrane 210 isolates the internal environment 116 of the downhole tool 110 from the external environment 114. The membrane 210 is positioned such that the membrane 210 is able to withstand force from external pressure on an outer surface of the membrane 210 and force from internal pressure on an inner surface of the membrane 210.

In this embodiment, positioning 304 comprises positioning the heating element 212 in the valve housing 120 such that the heating element 212 is configured to heat the membrane 210 upon electrical current passing through the heating element 212. In this embodiment, the heating element 212 is in contact with the membrane 110 such that heating the membrane 210 causes the membrane 210 to at least partially soften and/or melt.

In this embodiment, applying 306 the electrical current comprises applying the electrical current to the heating element 212. Applying the electrical current to the heating element 212 heats the membrane 210 to soften and/or melt the membrane 210. As a person skilled in the art will appreciate, once the membrane 210 is heated and/or melted, the membrane 210 may rupture due to external or internal pressure. In this embodiment, applying 306 further comprises activating the heating element 212 via the power source/controller electrically connected to the heating element 212 via the electrical connection 214. In this embodiment, activating the heating element 212 comprises receiving a control signal at the controller and activating the heating element 212 via the power source.

Figure 4:
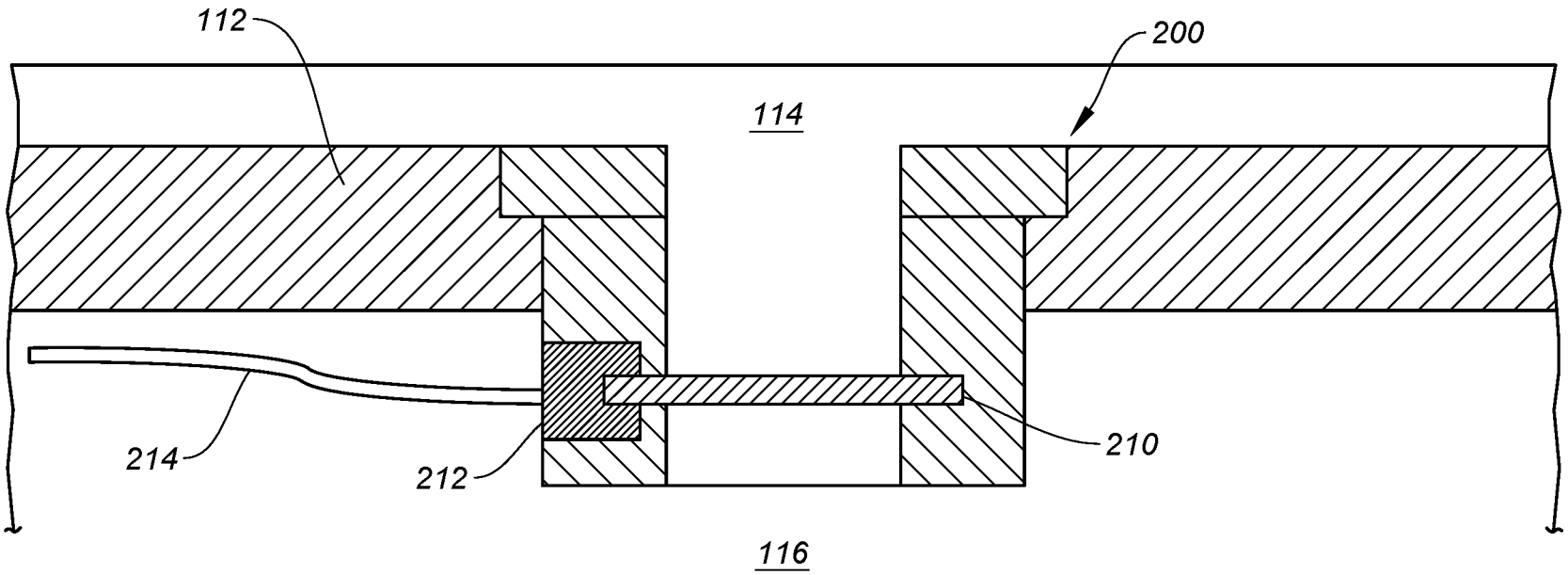
FIG. 4 is a simplified representation of a valve of a downhole tool during activation.
Figure 5:
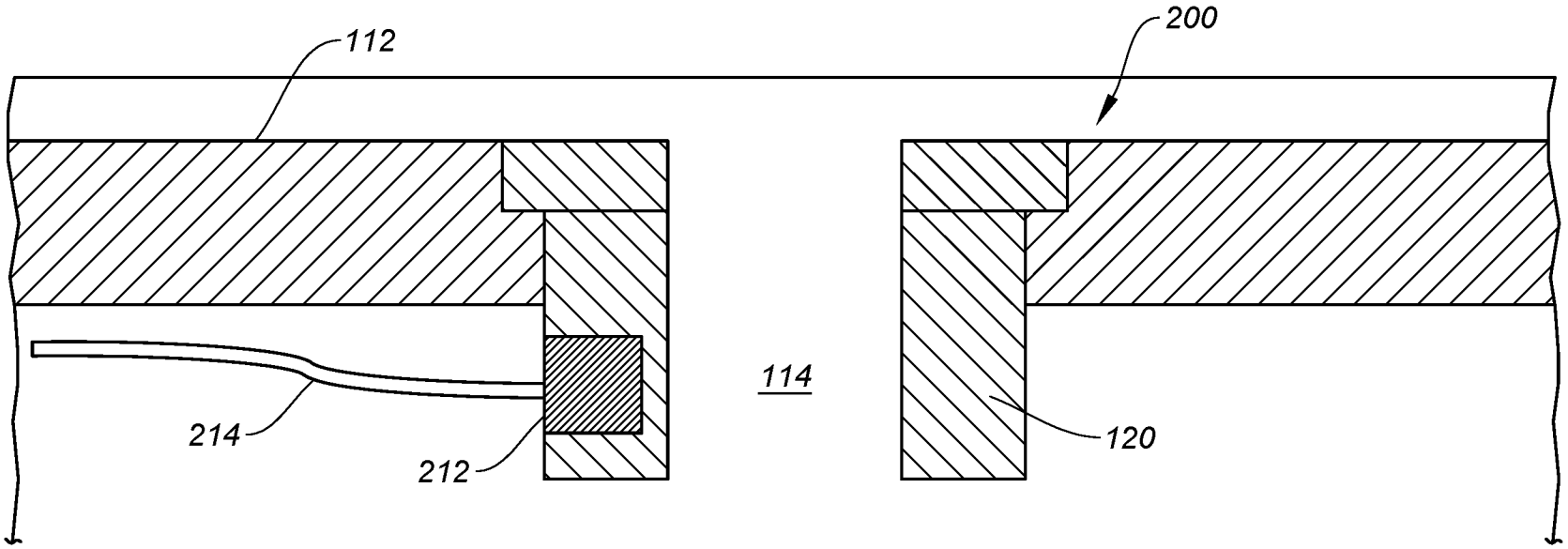
FIG. 5 is a simplified representation of a valve of a downhole tool after activation.

As shown in FIGS. 4 and 5, in operation, the power controller receives a control signal to activate the heating element 212. The controller controls the power source to power the heating element 212 via the electrical connection 214. The heating element 212 is then activated and heats the membrane 210. The membrane 210 softens, melts and/or ruptures. Once the membrane 210 has been softened, melted and/or ruptured, pressure is released into or out of the internal environment 116 of the downhole tool 110.

As shown in FIG. 5, in this embodiment, the external pressure is greater than the internal pressure so pressure is released from the external environment 114 into the internal environment 116. The released pressure at least partially operates the hydraulically functioning element of the downhole tool 110. In this embodiment, the functioning element comprises at least one of moving a piston, activating a further valve, opening and/or closing a valve, firing one or more perforating guns, fracturing a formation and collecting a sample. Exemplary valve types include ball, gate, globe, plug, butterfly, check, diaphragm, pinch, pressure relief and control valves.

Figure 6:
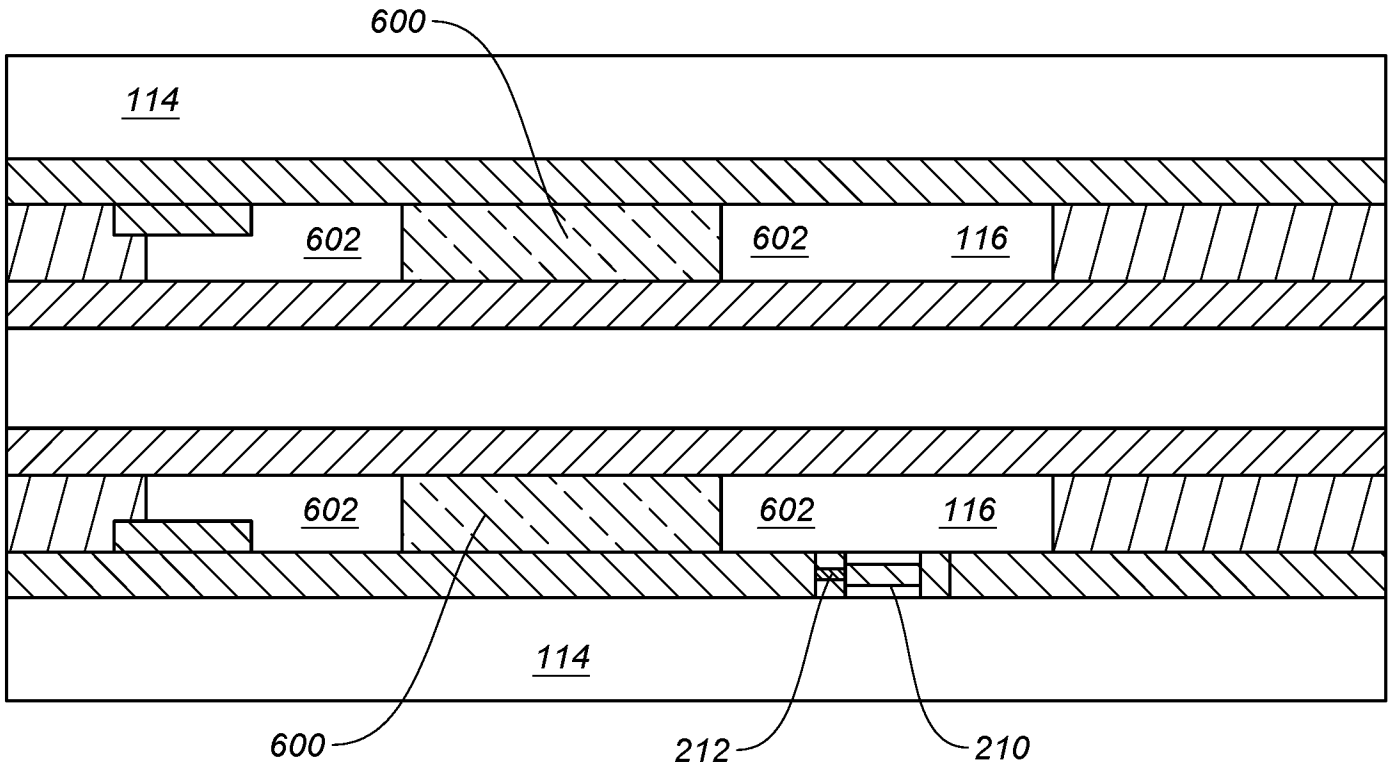
FIG. 6 is a simplified representation of a valve of a downhole tool with a hydraulic piston.
Figure 7:
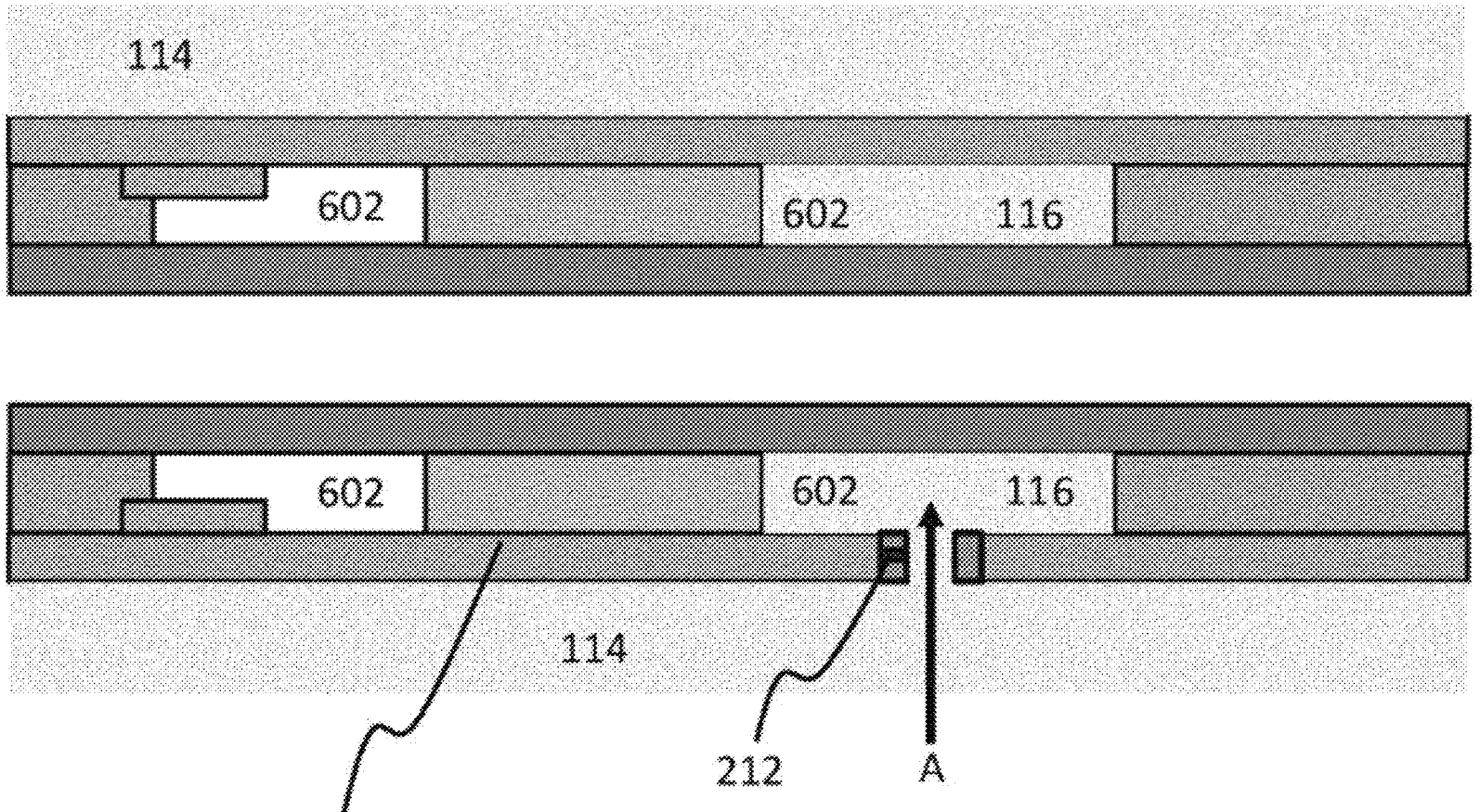
FIG. 7 is a simplified representation of a valve of a downhole tool with a hydraulic piston during activation.
Figure 8:
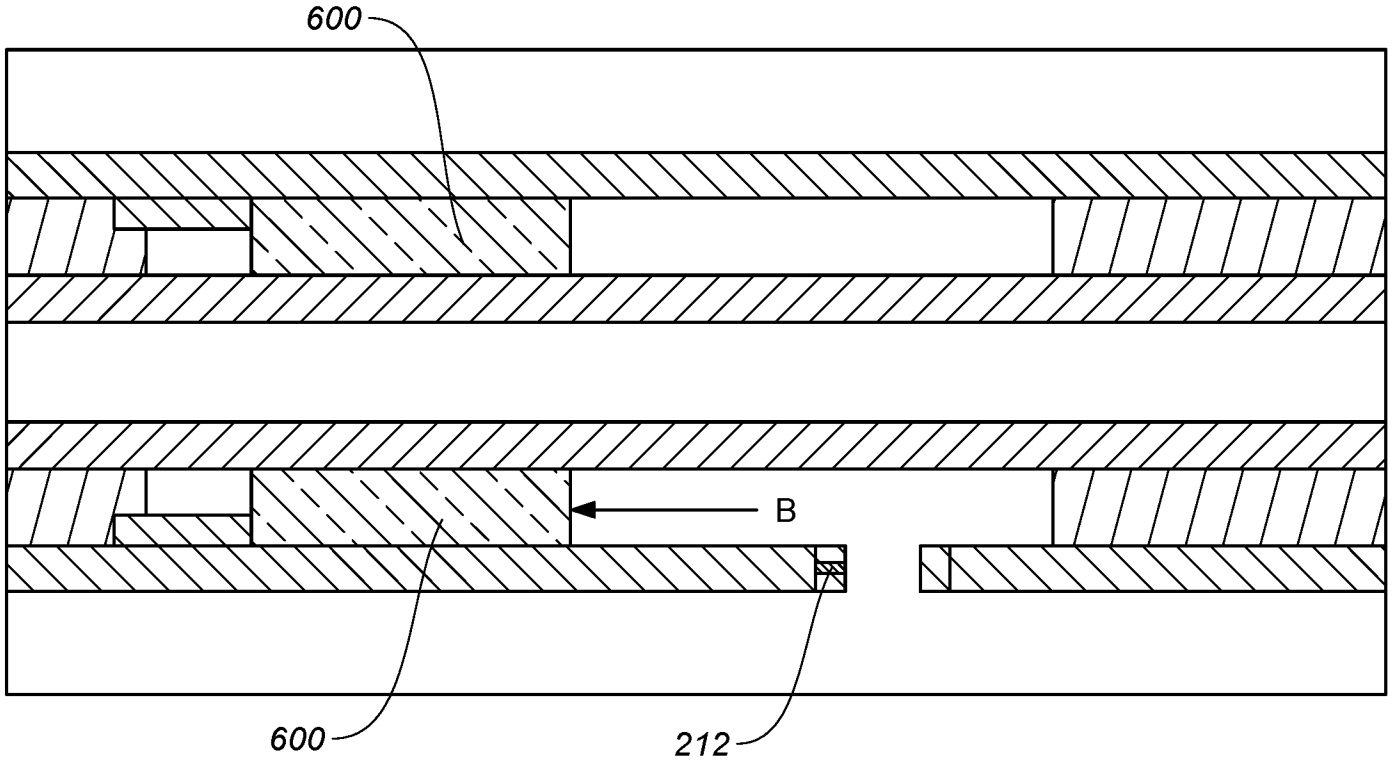
FIG. 8 is a simplified representation of a valve of a downhole tool with a hydraulic piston after activation.

A particular example of the hydraulically functioning element is shown in FIGS. 6 to 8. In this example, the hydraulic functioning element comprises a hydraulic piston 600. The hydraulic piston 600 is housed in a piston housing 602. The piston 600 is actuated to move within the housing 602 via hydraulic pressure. The membrane 210 is positioned proximate one end of the piston housing 602 such that softening, melting and/or rupture of the membrane 210 allows for fluid communication between the external environment 114 and the internal environment 116 defined by the end of the piston housing 602.

In use, the controller controls the power source to power the heating element 212. The heating element 212 is then activated and heats the membrane 210. The membrane 210 softens, melts and/or ruptures. Once the membrane 210 has been softened, melted and/or ruptured, pressure is released from the external environment 114 into the internal environment 116 of the piston housing 602, as the external pressure is greater than the internal pressure. As shown in FIG. 7, pressure is released in the direction of Arrow A into the piston housing 602. The pressure actuates the piston 600 to move within the housing 602 in the direction of Arrow B as shown in FIG. 8. Movement of the piston 600 may activate some downhole tool, gauge or element.

After use, the downhole tool 110 may be reused by positioning a unit, enclosure or assembly comprising a new membrane 210 within the valve housing 120 to isolate the external and internal environments 114 and 116, respectively. The heating element 212 may be reused to heat the newly positioned membrane 210. Thus, the heating element 212 is reusable.

In contrast with larger, more expensive and complex downhole tool 110, the valve 200 provides for pressure release that may be used to perform a downhole function without a large, expensive and/or complex power supply to provide tool functionality such as motorized screws, pressurized oil reservoir or other medium. As the valve 200 only the heating element 212 to heat the membrane 210 to release pressure, a large, expensive and complex power source is not required, in contrast with conventional electrically controlled downhole tools.

Furthermore, in contrast with pressure activated rupture discs, the valve 200 is heat not pressure activated and as such is not dependent on a particular pressure window.

In another embodiment, the internal pressure is greater than the external pressure and pressure released from the internal environment 116 into the external environment 114 protects against overpressurization of the internal environment 116 of the downhole tool 110.

While a particular valve 200 has been described, a person skilled in the art will appreciate that other configurations are possible. In another embodiment, a membrane 210 is provided. The membrane 210 is configured to isolate the internal environment 116 of a downhole tool 110 from one or more further environments, internal and/or external to the downhole tool 110, and further configured to be weakened and/or ruptured when energy generated by an electrical current passing through an electrical element proximal to the membrane is incident thereon to allow fluid communication between the internal environment and the further environment.

In this embodiment, the further environment is the external environment 116.

In this embodiment, the membrane 210 spans the valve housing 120 of the downhole tool 110. The membrane 210 is disc shaped. The membrane 210 comprises zinc alloy. The membrane 210 has a melting point of 420 degrees Celsius. As previously described, other materials may be used with different respective melting points.

The membrane 210 is configured to not ruptured from forces exerted by the internal and external pressures on the internal and external surfaces of the membrane 210, respectively.

In this embodiment, the electrical element is the heating element 212. The heating element 212 is in contact with the membrane 210 and weakens and/or ruptures the membrane 210 when an electrical current passes through the heating element 212. In this embodiment, the heating element 212 is configured to at least partially soften and/or melt the membrane 210 to allow fluid communication between the environments 114 and 116.

While a particular downhole tool 110 has been described, a person skilled in the art will appreciate that other configurations are possible. In another embodiment, the downhole tool 110 comprises more than valve 200. Each valve 200 comprises a separate and unique membrane 210. The electrical element associated with each membrane 210 may be separately controlled to weakened and/or rupture the associated membrane 210. Accordingly, the downhole tool 110 may be controlled to operate a variety of hydraulically controlled elements by controlled the various electrical elements to weaken and/or rupture their respective membranes 210.

While the membrane 210 has been described as being configured to soften and/or melt when exposed to heat energy, a person skilled in the art will appreciate that other configurations are possible. In another embodiment, the membrane 210 is configured to become weaker when exposed to the energy is incident on the membrane 210. Once the membrane 210 has been weakened pressure is released into or out of the internal environment 116 of the downhole tool 110.

While the apparatus has been described as comprising a valve 200, a person skilled in the art will appreciate that other configurations are possible. In another embodiment, the apparatus comprises at least one of a fluid release or relief device, a pressure release or relief device, a fluid communication device and a fluid communication controller. The devices and controller comprise the elements of the described valve 200 and function similarly.

While a particular valve 200 in relation to a downhole tool 110 has been described, a person skilled in the art will appreciate that other configurations are possible. In another embodiment, the valve 200 is a standalone device that is retrofitted to a downhole tool 110. In another embodiment, an existing pressure activated rupture disc on a downhole tool 110 is replaced with valve 200 configured to fit in the housing vacated by the pressure activated rupture disc. In this manner pressure dependent hydraulic activation may be replaced with electrically controlled hydraulic activation while not significant increasing the complexity, cost or size of the downhole tool 110.

While a particular valve 200 has been described, a person skilled in the art will appreciate that other configurations are possible. In another embodiment, the membrane 210 forms a portion of the sidewall 112 of the downhole tool 110. The electrical element is positioned such that it is configured to heat the membrane 210 to allow pressure into or out of the internal environment 116 of the downhole tool 110.

The applicant discloses in isolation each individual feature described herein and any combination of two or more such features, to the extent that such features or combinations are capable of being carried out based on the specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description it will be evident to a person skilled in the art that various modifications may be made within the scope of the invention.

The invention claimed is:

1. An apparatus for use in a downhole tool, the downhole tool having a hydraulically functioning element comprising a hydraulic piston housed in a piston housing, wherein the hydraulic piston is configured to move within the housing by hydraulic pressure, the apparatus comprising:

a membrane configured to isolate an internal environment of the downhole tool from one or more further environments, internal and/or external to the downhole tool; and an electrical element configured to conduct an electrical current;

wherein the electrical element is positioned with respect to the membrane such that energy generated by the electrical current passing through the electrical element is incident on the membrane; and wherein the membrane is configured to be weakened and/or ruptured when the energy is incident thereon to allow fluid communication between the internal environment and the further environment; and wherein the apparatus is configured to be disposed relative to the downhole tool such that upon weakening and/or rupturing of the membrane, a fluid is released into the internal environment and at least partially operates the hydraulically functioning element.

2. The apparatus of claim 1, wherein the energy comprises heat energy.

3. The apparatus of claim 2, wherein the membrane is configured to soften and/or melt when exposed to the heat energy.

4. The apparatus of claim 3, wherein a melting point of the membrane is approximately 350 degrees Celsius, 420 degrees Celsius or 460 degrees Celsius.

5. The apparatus of claim 1, wherein the membrane comprises zinc alloy, tin alloy, magnesium alloy or aluminum alloy, or a combination thereof.

6. The apparatus of claim 1, wherein the electrical element comprises an electrically conductive wire.

7. The apparatus of claim 6, wherein the electrically conductive wire is secured to the membrane.

8. The apparatus of claim 6, wherein the electrically conductive element is in direct contact with the membrane.

9. The apparatus of claim 6, wherein the electrically conductive wire is formed into a planar structure, the planar structure having an area greater than 10% of a surface area of the membrane.

10. The apparatus of claim 1, further comprising a power source electrically connected to the electrical element and configured to supply electrical current thereto.

11. The apparatus of claim 10, further comprising a controller configured to control the power source.

12. The apparatus of claim 1, wherein the electrical element is reusable.

13. The apparatus of claim 1, wherein the membrane is disc shaped.

14. The apparatus of claim 1, wherein the membrane is configured to be supported within a housing of the downhole tool.

15. The apparatus of claim 14, further comprising a receiver configured to receive a control signal for controlling the controller.

16. The apparatus of claim 1, wherein the apparatus comprises a valve.

17. A downhole tool, comprising:

a hydraulically functioning element comprising a hydraulic piston housed in a piston housing, wherein the hydraulic piston is configured to move within the housing by hydraulic pressure, and wherein the hydraulically functioning element has an internal environment; and an apparatus that includes:

a membrane, wherein the internal environment is disposed on a first side of the membrane and a second environment is disposed on a second side of the membrane opposite the first side, wherein the membrane is configured to isolate the internal environment from the second environment; and an electrical element configured to conduct an electrical current, wherein the electrical element is positioned with respect to the membrane such that energy generated by the electrical current passing through the electrical element is incident on the membrane; and wherein the membrane is configured to be weakened and/or ruptured when the energy is incident thereon to allow fluid communication between the internal environment and the second environment; and wherein the apparatus is disposed relative to the hydraulically functioning element such that upon weakening and/or rupturing of the membrane, a fluid is released into the internal environment and at least partially operates the hydraulically functioning element.

18. The downhole tool of claim 17, wherein operation of the hydraulically functioning element further comprises at least one of, activating a further valve, opening and/or closing a valve, firing one or more perforating guns, fracturing a formation and collecting a sample.

19. The downhole tool of claim 17, wherein the apparatus is configured to release pressure out of the internal environment for protecting against overpressurization.

20. A method of operating a downhole tool, the method comprising:

providing a hydraulically functioning element comprising a hydraulic piston housed in a piston housing, wherein the hydraulic piston is configured to move within the housing by hydraulic pressure, and wherein the hydraulically functioning element has an internal environment;

using a membrane to isolate the internal environment of the hydraulically functioning element from a second environment, wherein the internal environment is disposed on a first side of the membrane and a second environment is disposed on a second side of the membrane opposite the first side;

positioning an electrical element configured to conduct an electrical current, with respect to the membrane such that energy generated by the electrical current passing through the electrical element is incident on the membrane; and applying the electrical current to the electrical element to weaken and/or rupture the membrane when the energy is incident thereon to allow fluid communication between the internal environment and the further environment;

wherein the weakened and/or ruptured membrane allows passage of a fluid from the second environment to the internal environment in a manner that at least partially operates the hydraulically functioning element.

21. The method of claim 20, wherein the energy comprises heat energy.

* * * * *